US006471370B2

(12) United States Patent
Schleifer

(10) Patent No.: US 6,471,370 B2
(45) Date of Patent: Oct. 29, 2002

(54) COLOR EFFECT LIGHT

(76) Inventor: Wolf-Dieter Schleifer, Dianastrasse 1, Haar (DE), D-85540

( * ) Notice: Subject to any disclaimer, the term of this patent is extended or adjusted under 35 U.S.C. 154(b) by 0 days.

(21) Appl. No.: 09/814,685

(22) Filed: Mar. 15, 2001

(65) Prior Publication Data

US 2001/0021109 A1 Sep. 13, 2001

Related U.S. Application Data

(63) Continuation of application No. PCT/DE99/02918, filed on Sep. 14, 1999.

(30) Foreign Application Priority Data

Sep. 15, 1998 (DE) ..... 198 42 253

(51) Int. Cl.[7] ..... F21V 7/00

(52) U.S. Cl. ..... 362/231; 362/311; 362/300; 362/247

(58) Field of Search ..... 362/231, 235, 362/806, 298, 240, 237, 241, 247, 249, 252, 300, 310, 311

(56) References Cited

U.S. PATENT DOCUMENTS 3,611,603 A * 10/1971 Gesner, III ..... 362/231
3,949,350 A 4/1976 Smith
5,255,171 A * 10/1993 Clark ..... 362/231
5,749,646 A 5/1998 Brittell ..... 362/231
6,241,363 B1 * 6/2001 Lee ..... 362/231

FOREIGN PATENT DOCUMENTS

EP 0242422 A1 10/1987
GB 1007257 10/1965

* cited by examiner

*Primary Examiner*—Thomas M. Sember
(74) *Attorney, Agent, or Firm*—Jacobson Holman, PLLC

(57) ABSTRACT

A color effect light or lamp with a three-dimensionally extending transparent lampshade on which luminous areas of various forms and colors are to be produced. A light mixing and reflecting body having an effective three-dimensionally shaped outside-surface is at least partially surrounded by the transparent lampshade. Differently colored illuminants whose brightness can be regulated separately are provided to illuminate the outside-surface of the light mixing and reflecting body, and spaced from one another. Preferably, each illuminant includes directing member for concentrating or focusing the light into a homogeneously coloured light beam, and is adjusted to cast its light beam in a direction to the effective outside-surface of the light mixing and reflecting body where differently colored light beams meet one another and are transformed by additional mixing into light of various colors. This light is reflected onto the inside of the transparent lampshade which transmits it to its outside producing the luminous areas of various forms and colors.

6 Claims, 1 Drawing Sheet

COLOR EFFECT LIGHT

This is a Continuation Application of PCT International Application No. PCT/DE99/02918, filed Sep. 14, 1999.

BACKGROUND OF THE INVENTION

The invention relates to a colour effect light or a lamp with colour effect which produces light of every colour. The light production principle is based on the well-known principle of "additive colour mixing". In this technique, the three primary colours red, green and blue are projected over one another and, depending on the intensity of the various colours, give every colour of the rainbow including white.

The present invention is concerned with the application of this principle for use in a colour effect light.

Heretofore, colour effect lights or lamps with colour effect have been disclosed by Brittell in U.S. Pat. No. 5,749,646 concerning special effect lamps, by Smith in U.S. Pat. No. 3,949,350 concerning an ornamental lighting device, and Winstanley in GB-A-1,007,257 concerning apparatus for producing coloured light effects. Vobgeli in EP-A-0,242,422 describes a floodlight projector for coloured light. The prior art comprises a whole range of products using coloured illuminants whereby additive colour mixing takes place at the lampshade, as has conventionally been the case. In order that the desired colour effects can occur, the lampshade must have a functionally pre-determined shape, i.e., the lampshade or sections of the surface of the lampshade, on which the colour effects should take place as a result of light mixing, must be arranged in a pre-determined spatial position with respect to the light rays of the colour light sources. This pre-determined position of the light-mixing sections can be achieved by means of a pre-determined shape of the lampshade. However, this lampshade can no longer be selected freely. However, the shape of a lampshade is essentially determined from aesthetic considerations. But a lampshade shaped under aesthetic considerations does not generally exhibit the geometry required to produce the colour effect. Since the external, visible shape of the lampshade generally takes precedence over the functionality, i.e., for the production of colour effects, there is little variability in the colour effects that can be achieved with these lamp configurations.

The problem for the invention is thus to prepare a colour effect light with which highly variable colour effects can be produced without the external, aesthetically predetermined shape of the lampshade being changed to achieve this.

SUMMARY OF THE INVENTION

The invention is solved by a colour effect light or lamp with colour effect, with several differently coloured illuminants whose brightness can be regulated separately, and a three-dimensionally extending transparent lampshade, this colour effect light or lamp with colour effect being characterized in that inside the lampshade there is provided a light-mixing and reflecting body having a three-dimensionally shaped outside-surface illuminated by the differently coloured illuminants which are directed to the light-mixing and reflecting body from different sides whereby the light from the illuminants is mixed additively by the light-mixing and reflecting body, and the additively mixed light from the light-mixing and reflecting body is reflected onto the inside of the lampshade where it is visible to the observer as a colour effect. Advantageous further developments are the subject of dependent claims.

The light-mixing and reflecting body is, for example, a cone made of optically clear plastic with a matt surface. The cone can also be hollow. When differently coloured light from different directions is incident on the outer surface of the cone, additive colour mixing takes place at the outer surface. Some of the light can also penetrate into the cone and re-emerge on the opposite side. On this side the incoming light then mixes with the emerging light which also gives rise to colour effects.

The shape of the light-mixing and reflecting body can be arbitrary and influences the shape and colour effects on the lampshade. The only thing that matters is that additive colour mixing takes place at the surface of the light-mixing and reflecting body and this mixed light is reflected onto the lampshade. In order to produce a wide range of light effects, the brightness of the illuminants can be regulated whereby even white light can be produced.

The light-mixing and reflecting body may be opaque, e.g. matt white. Additive mixing only takes place at the surface section of the light-mixing and reflecting body which is directly illuminated by the appropriate illuminants. This mixed light is reflected from this surface section onto the inner surface of the lampshade and appears there as a coloured light spot. If the colour components are uniformly distributed, a white light spot appears.

The light-mixing and reflecting body is preferably transparent and has a surface suitable for additive light mixing. For example, this can be a glass body having a matt surface. At this matt surface some of the incident light is mixed and is directed onto the inside of the lampshade as mixed light. The rest of the light reflected from the coloured illuminants passes through the glass body and is incident on the opposite side of the glass body from inside on the matt surface where additive colour mixing also takes place. This mixed light is also directed onto the inside of the lampshade.

By adjusting the shape and the surface of the colour-mixing and reflecting body, especially its transparency and surface structure, the expert can produce a wide range of light-mixing and colour effects.

Preferably, the light-mixing and reflecting body is a cone and the lampshade a cylinder. The cone stands on its apex and is positioned concentrically in the cylinder. The illuminates are arranged in a circle around the apex of the cone and illuminate the cone surface where the light is mixed additively and reflected onto the inside of the cylindrical lampshade.

The cone may be hollow and the cone surface may be made of a white, transparent plastic film. This embodiment is particularly suited to cost-effective production in large numbers.

The light-mixing and reflecting body is interchangeable. This measure is also suited to cost-effective production in large numbers.

BRIEF DESCRIPTION OF THE DRAWINGS

The invention is now explained in greater detail using an example with reference to the drawings.

DESCRIPTION OF THE INVENTION

Figure 1:
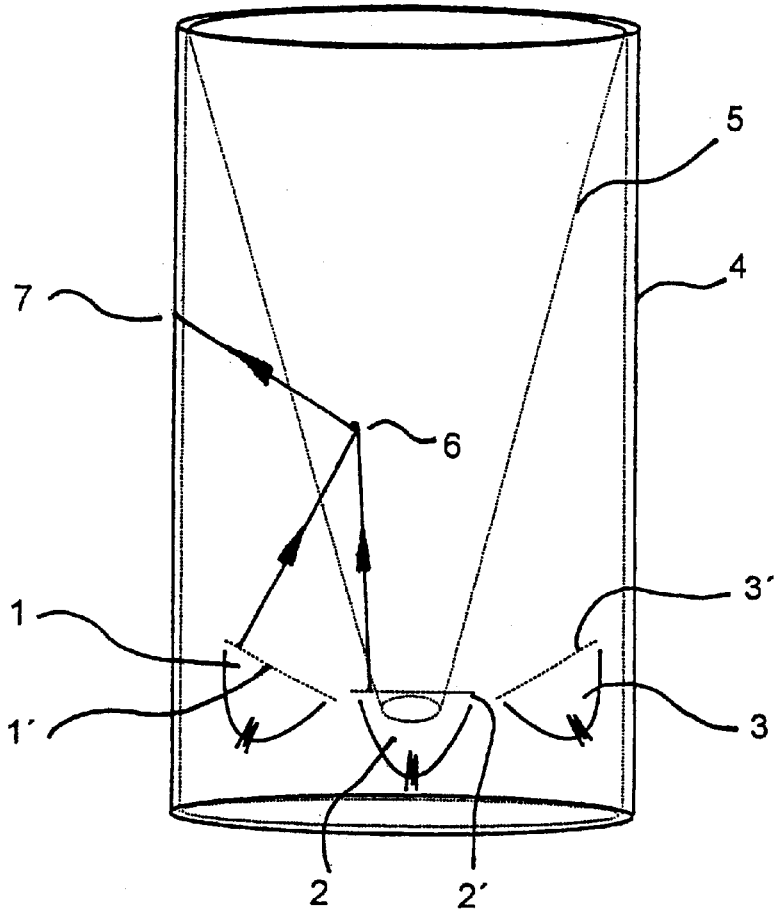
FIG. 1 shows a schematic diagram of the invention viewed from the side.
Figure 2:
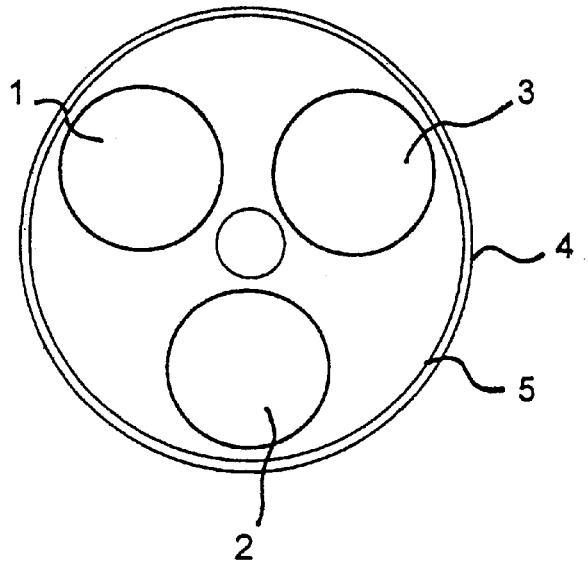
FIG. 2 shows a schematic diagram of FIG. 1 viewed from the top.

FIG. 1 shows a colour effect light with illuminates 1, 2 and 3 arranged in a star-shaped configuration and capable of being tilted so that their light cones can be adjusted. The illuminates 1, 2 and 3 are positioned at the lower end section of a cylindrical lampshade 4 and radiate obliquely upwards onto a cone-shaped light mixing and reflecting body 5. The illuminants can each have a colour filter 1', 2' and 3' as in this embodiment or a coloured glass bulb. The outgoing light rays from the illuminants 1 and 2 intersect on the surface of the cone-shaped light-mixing and reflecting body 5 at point 6. The mixed light produced there is reflected and is incident on the inside of the cylindrical lampshade 4 at point 7, which appears from outside as a coloured light spot.

It will be clear to the expert that the example of embodiment only shows one of many possible embodiments whereby however, the technical principle in connection with the remaining part of the description and the claims is disclosed so comprehensively that any embodiment of a colour effect light comes within the extent of protection of the following patent claims if the technical principle of the separate colour-mixing and reflecting body according to claim 1 is applied.

What is claimed is:

1. A colour effect light with several differently coloured illuminants whose brightness can be regulated separately, and with a three-dimensionally extending transparent lampshade, and with a three-dimensionally extending light mixing and reflecting body, comprising:

said light mixing and reflecting body having an effective three-dimensionally shaped outside-surface and is at least partially surrounded by said transparent lampshade, said differently coloured illuminants are provided with directing means concentrating or focusing light of said differently coloured illuminants into respective light beams, said differently coloured illuminants are spaced from one another, and adjusted to cast light beams from different positions on, and in direction to an effective outside-surface of said light mixing and reflecting body, said differently coloured light is mixed additively on the effective outside-surface of said light mixing and reflecting body where different light beams meet one another, and the light cast on the effective outside-surface of said mixing and reflecting body is reflected onto an inside of said transparent lampshade which transmits the reflected light outside where luminous areas of various forms and colours are effective.

2. The colour effect light according to claim 1, wherein said light-mixing and reflecting body is a cone and the lampshade is a cylinder whereby the cone standing on its apex is positioned concentrically in the cylinder and the illuminants are arranged in a circle around the apex of the cone and radiate onto the cone surface where the light is mixed additively and is reflected onto the inside of the cylindrical lampshade.

3. The colour effect light according to claim 1, wherein said cone is hollow and the cone surface is a white, transparent plastic film.

4. The colour effect light according to claim 1, wherein said light-mixing and reflecting body can be interchanged.

5. The coloured effect light according to claim 1, wherein said light mixing and reflecting body is partially transparent and gives way to some of the light passing through from one portion to another portion of its outside-surface where it emerges and may be mixed with light directly incident on this other portion.

6. The coloured effect light according to claim 1, wherein said light mixing and reflecting body is partially translucent and gives way to some of the light passing through from one portion to another portion of its outside-surface where it emerges and may be mixed with light directly incident on this other portion.

* * * * *